US005711442A

United States Patent [19]

Kusz

[11] Patent Number: 5,711,442

[45] Date of Patent: Jan. 27, 1998

[54] CHILD RESISTANT PACKAGE

[75] Inventor: Maximillian Kusz, Waterville, Ohio

[73] Assignee: Owens-Illinois Prescription Products Inc., Toledo, Ohio

[21] Appl. No.: 608,877

[22] Filed: Feb. 29, 1996

[51] Int. Cl.[6] ..... B65D 50/08

[52] U.S. Cl. ..... 215/209; 215/219; 215/221

[58] Field of Search ..... 215/216, 217, 215/218, 219, 220, 221, 223, 329, 330, 331, 209; 220/281

[56] References Cited

U.S. PATENT DOCUMENTS

| | | | |
|---|---|---|---|
| 2,532,729 | 12/1950 | Millstein | 215/331 X |
| 3,744,655 | 7/1973 | Nixdorff et al. | 215/216 |
| 3,884,379 | 5/1975 | Landen | 215/216 X |
| 3,939,788 | 2/1976 | Schneible | 215/216 X |
| 3,944,101 | 3/1976 | Landen et al. | 215/216 |
| 4,036,385 | 7/1977 | Morris . | |
| 4,099,639 | 7/1978 | Boxer et al. | 215/216 X |
| 4,241,856 | 12/1980 | Otterson . | |
| 4,365,721 | 12/1982 | Montgomery . | |
| 4,427,124 | 1/1984 | Marshall et al. | 215/216 |
| 4,464,316 | 8/1984 | Michaels . | |
| 4,630,743 | 12/1986 | Wright . | |
| 5,145,080 | 9/1992 | Imbery, Jr. . | |
| 5,184,741 | 2/1993 | Chevassus et al. | 215/330 X |
| 5,197,617 | 3/1993 | Edwards . | |
| 5,265,751 | 11/1993 | Lima et al. . | |
| 5,307,945 | 5/1994 | Hidding et al. | 215/329 |
| 5,307,946 | 5/1994 | Molinaro | 215/329 |
| 5,544,768 | 8/1996 | Gargione | 215/216 X |

*Primary Examiner*—Allan N. Shoap
*Assistant Examiner*—Nathan Newhouse

[57] ABSTRACT

A child resistant package including a container having an open end and multiple threads on the external surface of the container adjacent the upper end. A closure having a base wall and a peripheral skirt has an inner surface formed with multiple threads corresponding in number to the multiple threads on the container for engaging the threads on the container. A release element formed integrally on the exterior surface of the container below the threads. The release element includes an integral axial lug extending upwardly toward the open end of the container. The closure has a plurality of circumferentially spaced stops on the inner surface of the skirt of the closure below the threads corresponding in number to the threads on the closure and the number of threads on the container. The lug on the release element normally extends upwardly for engagement with at least one of the stops such that when the release element is pressed radially inwardly, the lug is disengaged from engagement with a stop and the closure can be removed by unthreading the closure from the container.

10 Claims, 2 Drawing Sheets

CHILD RESISTANT PACKAGE

This invention relates to child resistant packages.

BACKGROUND AND SUMMARY OF THE INVENTION

Child resistant packages have been devised in the prior art for the protection of young children. Among the prior art types of safety closures are those which involve the ratcheting engagement of teeth on a container screw cap with a yielding locking element or tooth on the container neck or body portion, the container locking tooth responding to a downward manual pressure to effect release of the closure of the child resistant package. Examples of such prior art type of cap are contained in U.S. Pat. Nos. 3,700,133; 3,884,379; 3,892,326; and 3,902,620.

It is also known in the prior art to provide a child resistant package in which a movable release element on the closure responds to lateral or side pressure to free the cap from interlocking engagement with teeth or other like projection means on the container. In U.S. Pat. No. 4,036,385, the child resistant package consists of a container body having a yielding resilient manually operable release element positioned on the side wall of the container near the end thereof which receives a screw-threaded cap. The release element carries a single upstanding locking tooth which is capable of ratcheting to interlocking engagement with a tooth on a bottom skirt member of the threaded cap during rotation of the cap to gradually tighten it down on the threaded portion of the container. The release element responds to pressure applied by the thumb at one side of the container to shift the tooth of the release element inwardly on a substantially radial path relative to the axis of the container and container cap. This movement separates the tooth to the release element from the locking tooth means of the threaded cap so that the cap may be removed by simple rotation.

Among the objectives of the present invention are to provide a child resistant package wherein the amount of rotation of the closure relative to the vial would be reduced to approximately one quarter turn to provide a low removal torque to make the closure easy to unscrew; which has multiple threads with corresponding multiple stops and any one of these stops on the closure may cam over a locking tooth on the vial and lock the closure in the child resistant mode; which has a release element that is of sufficient radial width and axial thickness such that it is convenient for an adult to depress the release element and move it inwardly and downwardly yet difficult for a young child to operate.

DESCRIPTION OF THE PREFERRED EMBODIMENT

Figure 1:
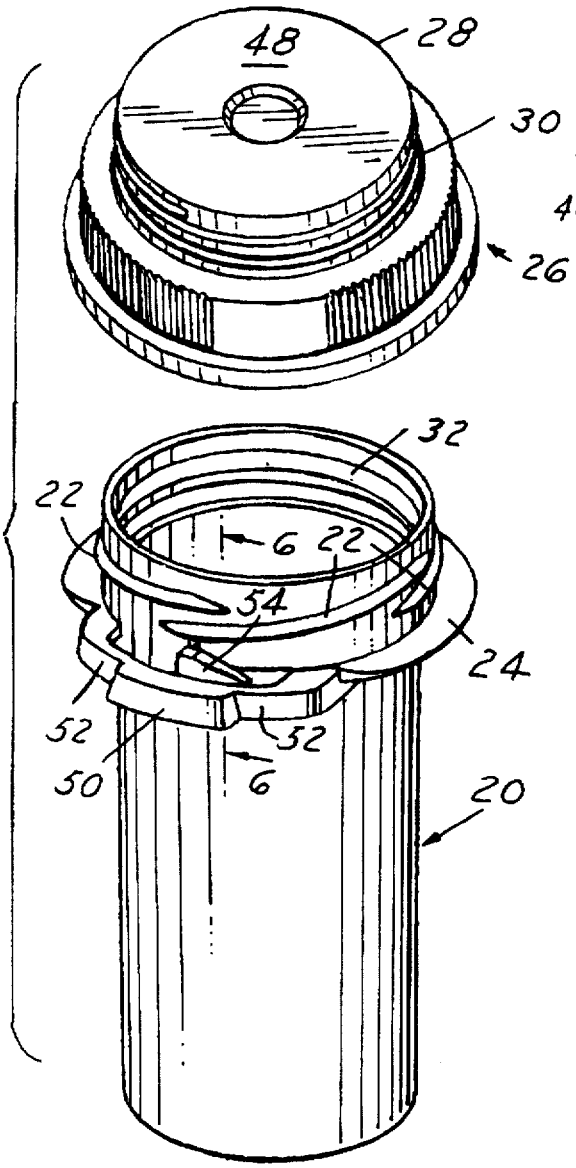
FIG. 1 is an exploded perspective view of child a resistant package embodying the invention.

Referring to FIGS. 1–7, the child resistant package comprises a cylindrical plastic container or vial 20 which has a multiple lead external thread 22 adjacent its upper open end and a radial flange 24 below the multiple lead threads. The multiple lead threads 22 preferably comprise four threads 22. At least one of the the threads 22 has an axially extending abutting surface 23 adjacent its leading end. The container 20 is adapted to receive a plastic closure 26. The closure 26 is preferably of a reversible type which has a cylindrical portion 28 which has an external thread 30 adapted to engage the internal thread 32 on the container 20 to close the container 20 when a non-child resistant mode of use is desirable.

The closure 26 also includes an annular radial flange 34 which extends from the base of the portion 28. A first annular peripheral skirt 36 extends axially downwardly from the radial flange 34 and is concentric with the portion 28. Multiple internal threads 38 are formed on the internal surface of skirt 36 and engage the external multiple threads 22 on the container 20. The internal threads 38 correspond in number to the number of external threads 22 and preferably comprise four threads. Each thread 38 includes a blunt leading thread end 39.

The closure 26 includes a second annular skirt 40 extending axially downwardly from the lower end of the skirt 36 and connected thereto by a second annular flange 42 such that the skirt 40 is spaced from the threads 38. A plurality of axially extending flat lugs or stops 44 extend from the inner surface of skirt 40 and correspond in number to the number of threads 22, 38. Each lug or stop 44 includes a flat radial surface lying in an axial plane.

Figure 6:
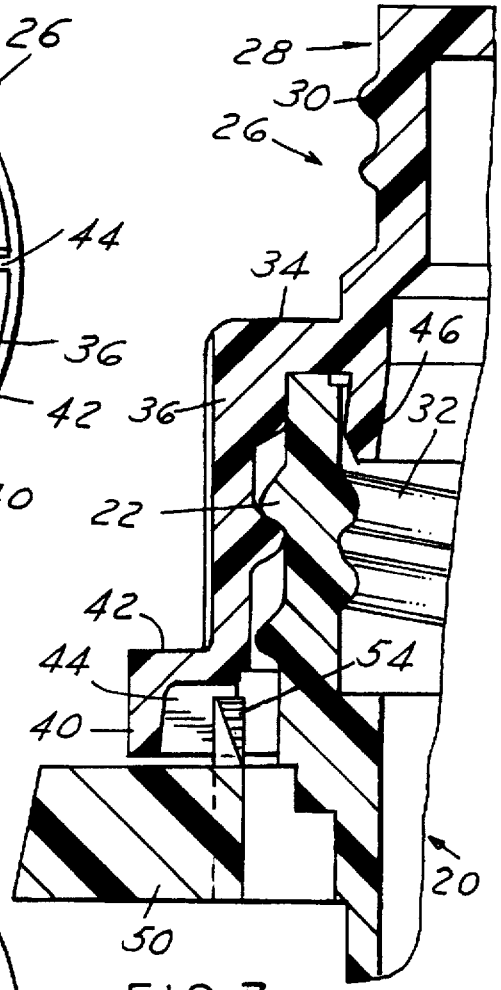
FIG. 6 is an enlarged vertical sectional view of a portion of the package.
Figure 5:
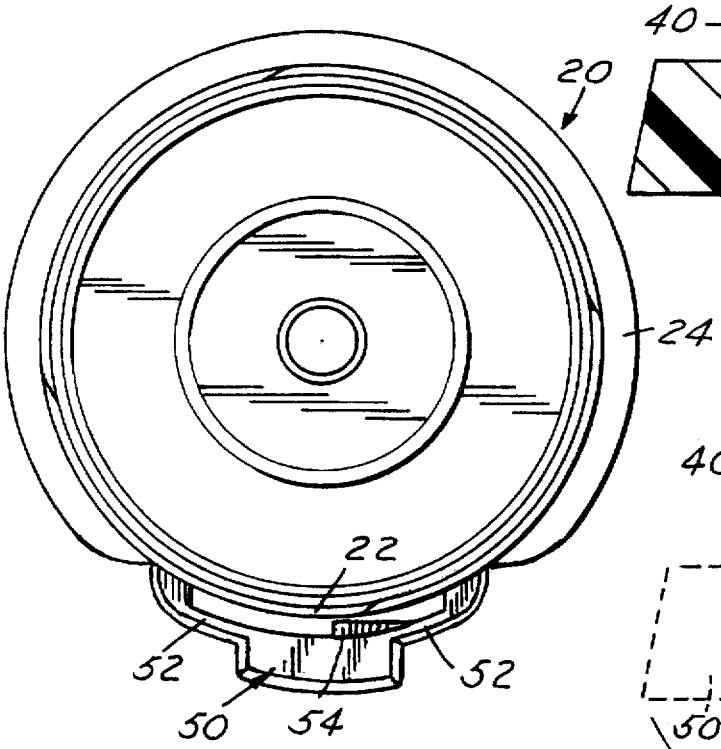
FIG. 5 is a top plan view of the closure.

The closure 26 may include an axial ring or plug portion 46 concentric with and spaced inwardly of skirt 36 and adapted to enter the mouth of the container 20 in spaced relation to the internal threads 32 when the cap is applied to the container as shown in FIG. 6. This forms a valve which seals on the interior of the container.

Figure 7:
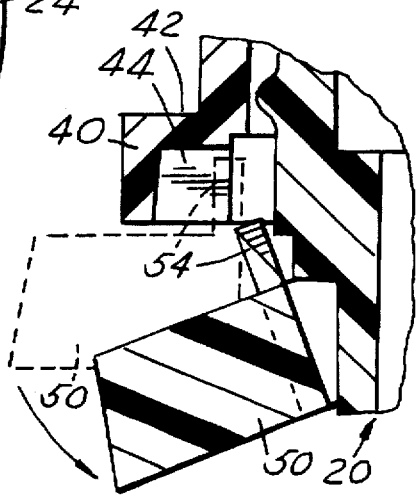
FIG. 7 is a fragmentary sectional view similar to FIG. 6 showing the parts in position for removal of the closure from the container.

A deflectable tab or release element 50 is mounted on the vial 20 at an interruption or space in the flange 24. The release element 50 is connected to the vial 20 by circumferentially spaced horizontal flexible and resilient arms 52 which are attached to the vial 20 at one end and to the release element 50 at the other end such that the release element is spaced from the vial. The deflectable release element 50 has a radial width and axial thickness which is sufficient to make the element convenient for an adult to depress the element yet difficult for a child to operate. A single integral locking tooth 54 extends axially upwardly from the release element 50. The release element 50 responds to thumb or finger pressure applied radially of the closure 26 and container 20 such that the connecting arms 52 bend and the release element 50 swings radially inwardly and downwardly to separate the single locking tooth 54 on the release element 50 out of interlocking engagement with a stop 44 on the closure 26 as the closure is rotated for removal (FIG. 7).

Figure 8:
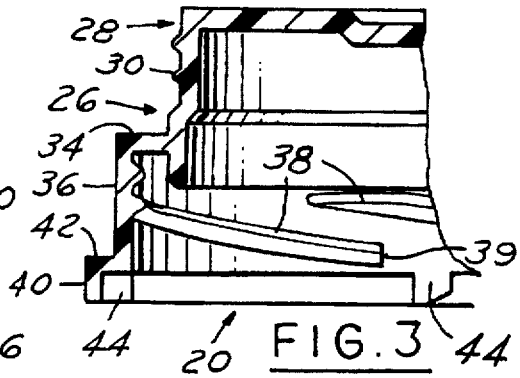
FIG. 8 is a fragmentary sectional elevational view of the closure.
Figure 3:
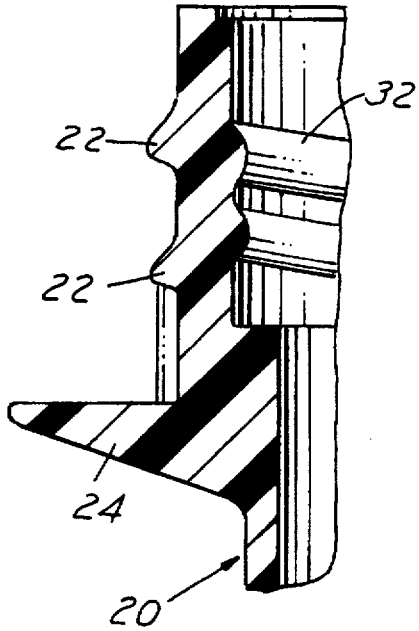
FIG. 3 is a fragmentary sectional view taken along the line 3—3 in FIG. 2.
Figure 2:
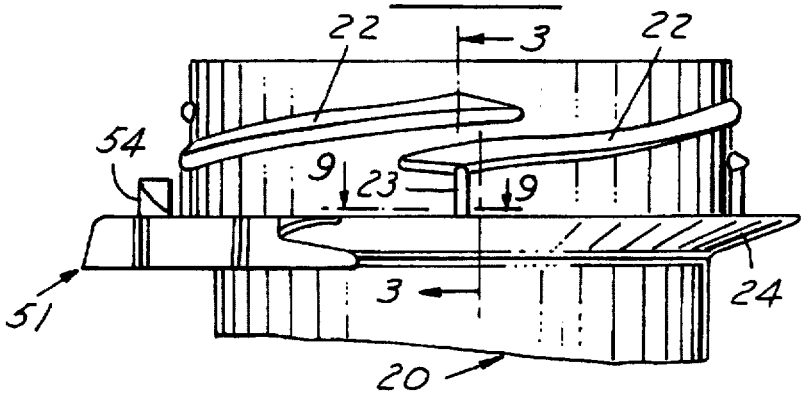
FIG. 2 is a fragmentary elevational view of a portion of the container.
Figure 9:
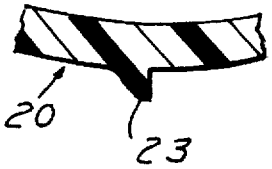
FIG. 9 is a fragmentary sectional view taken along the line 9—9 in FIG. 2.
Figure 4:
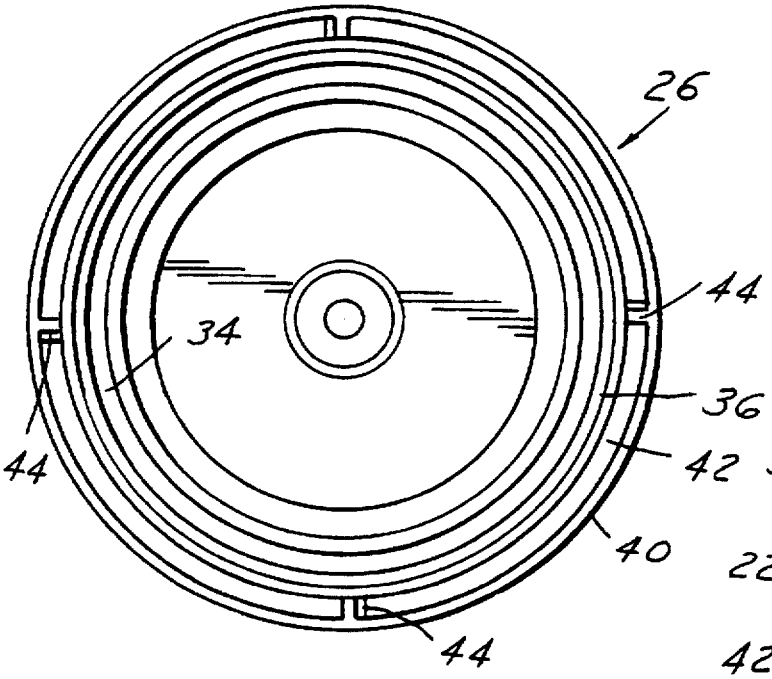
FIG. 4 is a bottom plan view of the closure.

The stops 44 and cooperating locking tooth 54 have corresponding sloping faces as shown clearly in FIGS. 1 and 8 whereby during rotation of the closure 26 to tighten it on the container 20, one of the several stops 44 will easily ratchet over the locking tooth 54. During such operation, the release element 50 will yield axially downwardly and/or radially inwardly as the connecting arms 52 flex and twist to allow the necessary relative movement between the stops 44 and locking tooth 54. However, during the package opening operation, to free or unlock the closure 26, the release element 50 must be shifted by thumb pressure in a radial and/or downward direction so as to remove the locking tooth 54 from the path of a stop 44 of the closure.

The plastic container 20 is preferably made of polypropylene and the closure 26 is preferably made of high density polyethylene. Other container materials which can be used, depending on the contents, are polypropylene, polyethylene, PET and PVC.

The operation of the child resistant package may be briefly summarized as follows. The closure 26 is applied to the container 20 and the threads 38 and 22 are engaged. As the closure 26 is rotated to gradually tighten it down on the container 20 to the fully closed position, a stop 44 of the closure 26 will pass over the locking tooth 54 of the container and the release element 50 will swing downwardly and inwardly on the container 20 as the connecting arms flex. Further rotation of the closure causes the release element 50 to move upwardly and outwardly with respect to the vial 20 as a stop 44 rotates past locking tooth 54 and the connecting arms 52 resiliently resume their original positions. Continued rotation brings the blunt thread ends 39 into contact with thread stops 23 and the closure cannot be rotated further in the apply direction. The contact of the blunt end 39 of thread 38 with a stop 23 prevents the closure 26 from being tightened excessively on the container 20. Because the closure 26 has not been tightened excessively, rotation of the closure 26 in a removal direction is relatively easy. There is no tightened interference that must be overcome to loosen the closure. That is, the closure 26 is relatively loose on the container 20. The package is essentially sealed by the interference fit of the valve 46 on the interior surface of the vial 20. The closure 26 is locked against normal rotational removal by a child through interengagement of the locking tooth 54 and one of the stops 44 on the closure 26 (FIG. 6). To remove the closure 26 from the container 20, the user first presses the release element 50 radially inwardly and downwardly by flexing of the arms 52 to separate the locking tooth 54 from the stops 44 and while holding the release element in this position (FIG. 6), and the closure 26 is rotated in a counter clockwise direction for moving the closure axially upwardly with respect to the vial.

It can thus be seen that the invention achieves the objective of providing a child resistant package which is more user friendly by having the following features:

1. Using multiple threads 22 that permit the opening and/or closing of the package with approximately one quarter turn of the closure.

2. While there is only one locking tooth 54 there are multiple lugs or stops 44, each being associated with one of the threads 22 on the closure. Any one of the lugs is capable of locking the closure on the container in the child resistant mode by abutting against locking tooth 54. If the closure is randomly reapplied to the vial after each opening, the lug engagement will be evenly distributed among the lugs 44 and the package should remain child resistant after many opening/closing cycles.

3. Using a blunt thread start 39 on the closure and an abutting surface 23 at the thread root on the vial or container 20 so that when the closure is applied sufficiently to have a lug 44 on the closure 26 rotate past the locking tooth 54 on the container 20, the blunt end of the thread start 33 will contact the abutting surface 23 at the thread root on the container preventing further rotation of the closure will respect to the container. The purpose of the blunt thread end 39 on the closure and abutting surface 23 on the container is to prevent the closure from being over tightened.

The present invention uses multiple lugs and multiple threads on the closure. Each of the threads is associated with a lug and any one of the lugs can be used to lock the closure on the vial in the child resistant mode depending upon the orientation of the closure with the vial. To the best of knowledge of the inventor, the art does not show multiple thread start closures/vials with each thread start being associated with a locking lug, and any one of these locking lugs is capable of locking the package in the child resistant position. Also, the above multiple thread start/multiple lug in cooperation with blunt thread starts on the closure and abutting surfaces at the thread root on the container to provide a single relationship between a closure locking lug and the vial locking tab.

It can thus be seen that there has been provided a child resistant package which is consumer friendly because the amount of rotation of the closure relative to the vial would be reduced to approximately one quarter turn and would provide a low removal torque to make the closure easy to unscrew; which has multiple threads with corresponding multiple stops and any one of these stops on the closure may cam over a locking tooth on the vial and lock the closure in the child resistant mode; which has a release element that is of sufficient radial width and axial thickness such that it is convenient for an adult to depress the release element and move it inwardly and downwardly yet difficult for a young child to operate.

I claim:

1. A child resistant package comprising a plastic container having an open end, multiple threads on the external surface of the container adjacent the upper end, a plastic closure having a base wall and a first peripheral skirt, said skirt having an inner surface formed with multiple threads corresponding in number to the multiple threads on the container for engaging the threads on the container, a release element formed integrally on the exterior surface of the container below the threads, said release element including an integral axial lug extending upwardly toward the open end of the container, means mounting said release element on said container for radial and axial movement relative to said container, said closure having a second skirt radially outwardly of said first skirt, said second skirt having a plurality of circumferentially spaced stops on an inner surface of said second skirt of the closure below the threads corresponding in number to the threads on the closure and the number of threads on the container, said lug on said release element normally extending upwardly for engagement with at least one of said stops such that when the release element is pressed radially inwardly and axially downwardly, the lug is disengaged from engagement with a stop and the closure can be removed by unthreading the closure from the container.

2. The child resistant package set forth in claim 1 wherein each said thread on said closure has a blunt end and said container having at least one axial stop on the container beneath the leading end of one of said threads on the container such that when the closure is threaded on the container and the axial lug on the release element is moved past the stops on the closure, the blunt end on at least one of the threads on the closure engages the stop on the container adjacent the leading edge of the thread on the container.

3. The child resistant package set forth in claim 2 wherein said closure includes a radial flange supporting said second skirt.

4. The child resistant package set forth in claim 3 wherein said closure includes an integral valve portion sealingly engaging the internal surface of the open end of the container when the closure is applied to the container.

5. The child resistant package set forth in claim 4 including a cylindrical portion on the base wall of said closure extending axially upwardly from the base wall of the closure, said cylindrical portion having external threads thereon adapted to engage complementary internal threads on the interior surface of the container and thereby provide a non-child resistant mode of using the closure on the container.

6. The child resistant package set forth in claim 1 wherein each said thread on said closure has a blunt end and at least one said thread on the container has an axial stop beneath the leading end of one of said threads on the container such that when the closure is threaded on the container and the axial lug on the release element is moved past the stops on the closure, the blunt ends of the threads on the closure engages the stops on the leading ends of the threads of the container adjacent the leading edge of the thread on the container.

7. The child resistant package set forth in claim 2 wherein said closure includes an integral plug portion sealingly engaging the internal surface of the open end of the container when the closure is fully applied to the container, said plug portion having a length sufficient to enter the container and make circumferential contact with the interior of the container prior to the axial stop on the closure engaging and camming past the lug on the release element during application of the closure to the container.

8. The child resistant package set forth in claim 1 wherein each said thread on said closure has a blunt end and each said thread on the container has an axial stop beneath the leading end of one of said threads on the container for each blunt end such that when the closure is threaded on the container and the axial lug on the release element is moved past the stops on the closure, the blunt ends of the threads on the closure engages the stops on the leading ends of the threads of the container adjacent the leading edge of the thread on the container.

9. The child resistant package set forth in claim 8 wherein said closure includes a cylindrical portion having multiple threads extending axially in a direction opposite said first skirt such that the closure is reversible and may be used in a non-child resistant mode.

10. The child resistant package set forth in any one of claims 1–9 wherein said means for mounting said release element on said container comprises an arm at each end of said release element, said release element extending horizontally and circumferentially of said container, each said arm being horizontal, flexible and resilient such that when the closure is rotated to apply the closure, the release element will swing downwardly and inwardly on the container by flexing of the arms as the closure is rotated and the stops of the closure pass over the locking lug on the container and when the closure is rotated to remove the closure and the release element is pressed inwardly and downwardly, the connecting arms will flex; said release element having a radial width and axial thickness sufficient that it is convenient for an adult to depress the release element and move it inwardly and downwardly yet difficult for a young child to operate.

* * * * *